US006560563B1

(12) United States Patent
Lang

(10) Patent No.: US 6,560,563 B1
(45) Date of Patent: May 6, 2003

(54) L FACTOR METHOD FOR DETERMINING HEAT RATE OF A FOSSIL FIRED SYSTEM BASED ON EFFLUENT FLOW

(75) Inventor: Fred D. Lang, San Rafael, CA (US)

(73) Assignee: Exergetic Systems LLC, San Rafael, CA (US)

( * ) Notice: Subject to any disclaimer, the term of this patent is extended or adjusted under 35 U.S.C. 154(b) by 0 days.

(21) Appl. No.: 09/827,956

(22) Filed: Apr. 4, 2001

Related U.S. Application Data

(63) Continuation-in-part of application No. 09/759,061, filed on Jan. 11, 2001, which is a continuation-in-part of application No. 09/273,711, filed on Mar. 22, 1999, which is a continuation-in-part of application No. 09/047,198, filed on Mar. 24, 1998, now abandoned.

(51) Int. Cl.[7] ..... G06F 11/30
(52) U.S. Cl. ..... 702/182; 700/287
(58) Field of Search ..... 702/182; 364/494, 364/498, 496; 454/192; 420/62; 65/134; 110/347, 191; 431/12; 162/198

(56) References Cited

U.S. PATENT DOCUMENTS

| | | | | | |
|---|---|---|---|---|---|
| 3,859,079 | A | * | 1/1975 | Giles et al. | 420/62 |
| 4,617,046 | A | * | 10/1986 | Hals | 65/134.4 |
| 4,631,080 | A | * | 12/1986 | Westra et al. | 65/136.1 |
| 5,280,756 | A | * | 1/1994 | Labbe | 110/191 |
| 5,306,209 | A | * | 4/1994 | Lang | 454/192 |
| 5,327,356 | A | * | 7/1994 | Lang et al. | 702/22 |
| 5,367,470 | A | * | 11/1994 | Lang | 700/274 |
| 5,419,812 | A | * | 5/1995 | Beal | 162/198 |
| 5,563,803 | A | * | 10/1996 | Morihara et al. | 700/274 |
| 5,599,179 | A | * | 2/1997 | Lindner et al. | 431/12 |
| 5,790,420 | A | * | 8/1998 | Lang | 700/287 |

OTHER PUBLICATIONS

J.E. Roughton, "A Proposed On–Line Efficiency Method for Pulverized–Coal Fired Boilers", Journal of the Institute of Energy, Mar. 1980, pp 20–24.

S. Munukutla, "Heat Rate Monitoring Options for Coal–Fired Power Plants", Proceedings of Heat Rate Improvement Conference, Baltimore, Maryland, sponsored by Electric Power Research Institute of Palo Alto, CA, Sep. 1998.

N. Sarunac, C.E. Romero, E.K. Levy, "F–Factor Method for Heat Rate Measurement and its Characteristics", Proceedings of Twelfth Heat Rate Improvement Conference, Dallas, TX, sponsored by Elecgtric Power Research Institute of Palo Alto, CA, Jan. 30 to Feb. 1, 2001, Dallas, TX; presentation material only available in the proceedings.

F.D. Lang, A.F. Lang, "Monitoring and Improving Coal–Fired Power Plants Using the Input/Loss Method, Part II", ASME, 1999–IJPGC–Pwr–34, pp 373–382.

F.D. Lang, "Monitoring and Improving Coal–Fired Power Plants Using the Input/Loss Method—Part III", ASME, 2000–IJPGC–15079(CD), Jul. 2000.

T. Buna, "Combustion Calculations for Multiple Fuels", ASME Diamond Jubilee Annual Meeting, Chicago, IL, Nov. 13–18, 1955, Paper 55–A–185.

E. Levy, N. Sarunac, H.G. Grim, R. Leyse, J. Lamont, "Output/Loss: A New Method for Measuring Unit Heat Rate", Am. Society of Mech. Engrs., 87–JPGC–Pwr–39.

F.D. Lang, M.A. Bushey, "The Role of Valid Emission Rate Methods in Enforcement of the Clean Air Act", Proceedings of Heat Rate Improvement Conference, Baltimore, Maryland, soponsored by Electric Powwer Research Institute of Palo Alto, CA, May 1994, Baltimore, MD.

* cited by examiner

*Primary Examiner*—John Barlow
*Assistant Examiner*—Xiuqin Sun
(74) *Attorney, Agent, or Firm*—Gary Hoenig

(57) ABSTRACT

The operation of a fossil-fueled thermal system is quantified by obtaining effluent flow, the L Factor and other operating parameters to determine and monitor the unit's heat rate and to determine the emission rates of its pollutants.

15 Claims, 1 Drawing Sheet

L FACTOR METHOD FOR DETERMINING HEAT RATE OF A FOSSIL FIRED SYSTEM BASED ON EFFLUENT FLOW

This application is a Continuation-In-Part of U.S. patent application Ser. No. 09/759,061 filed Jan. 11, 2001, for which priority is claimed and whose disclosure is hereby incorporated by reference; application Ser. No. 09/759,061 is in turn a Continuation-In-Part of U.S. patent application Ser. No. 09/273,711 filed Mar. 22, 1999, for which priority is claimed and whose disclosure is hereby incorporated by reference in its entirety; application Ser. No. 09/273,711 is in turn a Continuation-In-Part of U.S. patent application Ser. No. 09/047,198 filed Mar. 24, 1998 now abandoned, for which priority is claimed and whose disclosure is hereby incorporated by reference in its entirety.

This invention relates to a fossil-fired power plant or steam generation thermal system, and, more particularly, to a method for determining its heat rate from the total effluents flow, the L Factor and other operating parameters. It also teaches how the EPA's F Factor may be properly used to monitor heat rate with certain precautions. It further teaches how the L Factor may be used to determine the system's emission rates of pollutants from fossil combustion with higher accuracy than afforded from the EPA's F Factor method.

BACKGROUND OF THE INVENTION

The importance of determining a fossil-fired power plant's or steam generation system's heat rate (inversely related to thermal efficiency) is critical if practical day-to-day improvements in heat rate are to be made, and/or problems in thermally degraded equipment are to be found and corrected. Although elaborate analytical tools are sometimes needed, simpler and less expensive methods are also applicable which do not require high maintenance nor the input of complex operational system data, and, also, whose accuracy is not greatly compromised. The L Factor method addresses this need.

General background of this invention is discussed at length in application Ser. No. 09/273,711 (hereinafter denoted as '711), and in application Ser. No. 09/047,198 (hereinafter denoted as '198). In '711 the L Factor is termed the "fuel factor".

As discussed in '711, related art to the present invention was developed by Roughton in 1980; see J. E. Roughton, "A Proposed On-Line Efficiency Method for Pulverized-Coal-Fired Boilers", Journal of the Institute of Energy, Vol.20, March 1980, pages 20–24. His approach using the L Factor (termed $M_d/I_d$ in his work) in developing boiler efficiency was to compute system losses such that $\eta_{Boiler}=1.0-\Sigma$ (System Losses). This is a version of the Heat Loss Method discussed in '711. The principle losses he considered were associated with dry total effluents (termed stack losses), effluent moisture loss and unburned carbon loss. Roughton's method produces boiler efficiency independent of any measured fuel flow and independent of any measured total effluents flow.

Related art known to the inventor since '711 and '198 were filed is the technical paper: S. S. Munukutla, "Heat Rate Monitoring Options for Coal-Fired Power Plants", *Proceedings of Heat Rate Improvement Conference,* Baltimore, Md., sponsored by Electric Power Research Institute, September 1998. In this paper Munukutla explains 40 CFR Part 60, Appendix A, Method 19, and the use of its F Factor to determine heat rate. Munukutla makes no mention of correction factors, neither conceptual nor those associated with measurement error. He concludes ". . . that the heat rate, as determined by the F-factor method, is in error by at least 10–20%." In his "Conclusions" section, Munukutla states that: "The F Factor method may give accurate results, provided the stack gas flow rate and $CO_2$ concentration can be measured accurately." He makes no mention of the molecular weight, or assumed composition, of the total effluents from combustion. Further, Munukutla explicitly states in his writing and by equation that system heat rate is inversely proportional to the concentration of effluent $CO_2$.

Other related art is the technical presentation by N. Sarunac, C. E. Romero and E. K. Levy entitled "F-Factor Method for Heat Rate Measurement and its Characteristics", presented at the Electric Power Research Institute's (EPRI) Twelfth Heat Rate Improvement Conference, Jan. 30 to Feb. 1, 2001, Dallas, Tex. and available from the proceedings (EPRI, Palo Alto, Calif.). This work discusses the $CO_2$ based $F_C$ Factor and the $O_2$ based $F_D$ Factor and their use in determining system heat rate. They stated that the F Factor method is not used due to its low precision and accuracy, siting 5 to 25% error compared to conventional heat rate methods. The authors site the principal sources of error as being the flue gas flow rate, and either the $CO_2$ concentration or the $O_2$ concentration measurement in the effluent. They discuss methods of improving the measurement accuracy of these quantities. These authors also indicate by equation that heat rate is inversely proportional to the concentration of effluent $CO_2$ or $O_2$.

Related art to the present invention also includes the EPA's F Factor method, discussed in '711, and whose procedures are specified in Chapter 40 of the Code of Federal Regulations (40 CFR), Part 60, Appendix A, Method 19. Assumed by Method 19 is that an $F_C$, $F_D$ or $F_W$ Factor is the ratio of a gas volume (of $CO_2$ or $O_2$) found in the combustion products to the heat content of the fuel.

SUMMARY OF THE INVENTION

The monitoring of a fossil-fired system may involve detailed and complete descriptive understanding of the fuel being burned, analyses of all major components, and accurate determination of its fuel flow. Such monitoring is possible by applying the Input/Loss Method discussed in '711 and '198. However, for many fossil-fired systems simpler methods are needed which allow the installation of analytical tools which provide an inexpensive, but consistent, indication of a system's thermal performance. From such indication, the system's efficiency may be monitored, deviations found, and corrections implemented. This invention discloses such a tool. Its accuracy is not at the level of the Input/Loss Method, but has been found to be within 1% to 2% when monitoring on-line, and, as importantly, has been demonstrated to be consistent.

This invention employs an L Factor to determine system heat rate. A heat rate may also be computed using the EPA's F Factor, but with additional error relative to the L Factor, but which may be tolerable. The L Factor and the F Factor may be used to determine heat rate only if certain correction factors are applied as taught by this invention. These correction factors are both conceptual and for routine measurement error.

The present invention, termed the L Factor Method, determines total fuel energy flow of a fossil-fired system resulting, when the total fuel energy flow is divided by the measured system electrical output, the heat rate of the system. Acceptable heat rate accuracy is achievable through the demonstrated high consistency found in the L Factor, to which this invention makes unique advantage.

The L Factor method does not use any part of the Heat Loss Method, it does not compute nor need any thermal loss term as used by Roughton. Unlike Roughton's method, the L Factor method employs the principle effluent flow or fuel flow associated with a fossil-fired system.

This invention is unlike the works of Munukutla and Sarunac, et al, several key areas. First, as taught by this invention, system heat rate using the F Factor is directly proportional to the concentration of effluent $CO_2$, not inversely proportional as stated by these authors. Further, this effluent $CO_2$ is associated with theoretical combustion, not actual combustion as these authors believe. Further, it has occurred during the development of this invention that certain conceptual correction factors must be applied to the L Factor to correctly and accurately monitor a fossil-fired system. No corrections of any kind are mentioned by these authors. This is significant to this invention for the F Factor affords one method of computing the L Factor (there is another which is preferred), however conceptual corrections which have been found to apply to the L Factor, also fundamentally apply to the F Factor. And lastly, these authors make no mention of the molecular weight, or alternatively the assumed composition, or alternatively the density of the total effluents being produced which this invention teaches must be addressed as different fossil fuels produce different mixes of combustion products comprising the total effluents.

In the process leading to the present invention, several problems existing with the F Factor concept have been both clarified and solutions found. These problems include the following: 1) large conventionally fired power plants have air in-leakage which alters the total effluents concentration's average molecular weight from base assumptions; 2) different Ranks of coal will produce different effluent concentrations thus different average molecular weights from base assumptions; 3) circulating fluidized bed boilers are injected with limestone to control $SO_2$, limestone produces $CO_2$ not addressed by the $F_C$ Factor; 4) many poor quality coals found in eastern Europe and from the Powder River Basin in the United States may have significant natural limestone in its fuel's mineral matter, thus producing effluent $CO_2$ not addressed by the $F_C$ Factor; 5) the EPA requires the reporting of emission rates based on measured wet volumetric flow reduced to standard conditions, but the quantity of effluent moisture is not independently measured, whose specific volume varies greatly as a function of its molar fraction thus introducing a major source of error in using volumetric flow; and 6) ideal gas behavior is assumed.

DESCRIPTION OF THE PREFERRED EMBODIMENT

The L Factor

Figure 1:
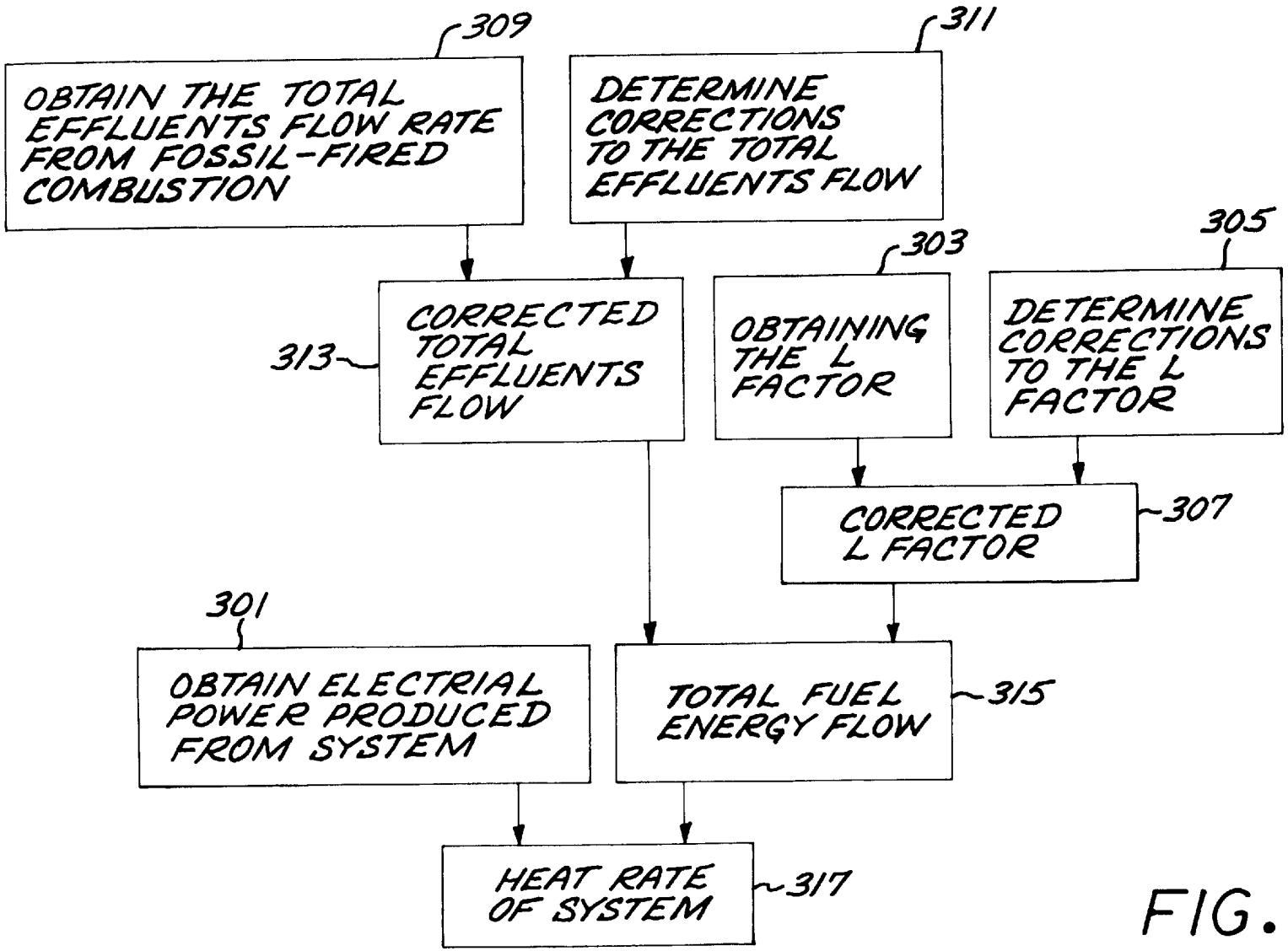
FIG. 1 is a block diagram illustrating the procedures involved in determining system heat rate using the L Factor.

This invention expands '711 by using its $L'_{Fuel}$ quantity (or its equivalence the $L_{Fuel}$ quantity), herein termed the L Factor, also known in '711 as the "fuel factor", to compute a thermal system's heat rate. $L'_{Fuel}$ is defined by Eq.(72) of '711, repeated here with one change:

$$L'_{Fuel}=10^6[x_{Dry\text{-}theor}N_{Dry\text{-}Fuel}+a_{Dry\text{-}theor}(1+\phi_{Ref})N_{Dry\text{-}Air}-J_{theor}N_{H2O}-x_{MAF\text{-}theor}\alpha_{MAF\text{-}10}N_{Ash}]/(x_{Dry\text{-}theor}N_{DryFuel}HHV_{Dry}) \quad (72A)$$

The difference is the term $\phi_{Ref}$ (which is the ratio of non-oxygen gases to oxygen used for ambient air conditions in Eq.(72A) and elsewhere by this invention, and is further discussed in '711), which was changed from $\phi_{Act}$. This invention teaches that $\phi_{Ref}$ must be employed since changes in combustion air's oxygen content should not effect the computed L Factor. The preferred embodiment is to set $\phi_{Ref}$=3.773725 as effects the determination of the L Factor; but also having an acceptable range such that $\phi_{Ref}$ is greater than a value of 3.7619 and less than a value of 3.7893 [i.e., $0.2088<A_{Ref}<0.2100$, where $\phi_{Ref}=(1-A_{Ref})/A_{Ref}$]. The equivalence of $L'_{Fuel}$ is $L_{Fuel}$, and is defined in words between Eqs.(75) and (76) in '711. When the quantities x, a and J of '711 are in percent, the calculational base is therefore 100 moles of dry gas, thus:

$$L_{Fuel}=10^6[100N_{DryGas/theor}]/(x_{Dry\text{-}theor}N_{Dry\text{-}Fuel}HHV_{Dry}) \quad (75A)$$

As fully explained in '711, the numerators of the right sides of these two equations are developed from the same mass balance equation involving dry fuel and stoichiometrics associated with theoretical combustion (also called stoichiometric combustion):

$$[x_{Dry\text{-}theor}N_{Dry\text{-}Fuel}+a_{Dry\text{-}theor}(1+\phi_{Ref})N_{Dry\text{-}Air}-J_{theor}N_{H2O}-x_{MAF\text{-}theor}\alpha_{MAF\text{-}10}N_{Ash}]=[100N_{DryGas/theor}] \quad (80)$$

Eq.(80) states that dry fuel, plus theoretical combustion air, less effluent water, less effluent ash results in dry gaseous total effluents associated with theoretical combustion. Eq. (80) is the bases for the L Factor; i.e., when each side of Eq.(80) is divided by $x_{Dry\text{-}theor}N_{Dry\text{-}Fuel}HHV_{Dry}$. This is fundamentally different than EPA's F Factor method. Although Eqs.(72A) & (75A) employ molar quantities, use of molecular weights results in a mass-base for the L Factor, and thus for Eq.(80). Unlike the F Factor, ideal gas assumptions are not applied nor needed. The molecular weight of the dry gas total effluents associated with theoretical combustion is the term $N_{DryGas/theor}$ (the identical quantity is denoted as $N_{Dry\text{-}Gas}$ in '711), its associated mass-base, or mass flow rate, is denoted as $m_{DryGas/theor}$. Common engineering units for the L Factor, which are perferred, are $pounds_{Dry\text{-}effluent}$/million-$Btu_{Fuel}$, or its equivalence; units of $feet^3{}_{Dry\text{-}effluent}$/million-$Btu_{Fuel}$, or its equivalence, may also be employed. The L Factor expresses the "emission rate" for dry gaseous total effluents from theoretical combustion of dried fuel.

For a coal fuel, having a unique Rank or uniquely mined, the L Factor has been shown to have a remarkable consistency to which this invention makes unique advantage when applied in determining heat rate. Standard deviations in $L_{Fuel}$ for coals range from 0.02% (for semi-anthracite), to 0.05% (for medium volatile bituminous), to 0.28% (for lignite B). Table 1 illustrates this, obtained from F. D. Lang, "Monitoring and Improving Coal-Fired Power Plants Using the Input/Loss Method—Part II", ASME, 1999-IJPGC-Pwr-34, pp.373–382. Listed in the third and fourth columns are standard deviations, in engineering units. Table 1 also presents moisture-ash-free higher heating values and computed $F_C$ Factors.

This paragraph discusses several definitions which are useful in understanding this invention. First, As-Fired fuel energy flow is numerically is the same as dry fuel energy flow for either actual combustion or theoretical combustion: $m_{As\text{-}Fired}HHV=m_{DryFuel/Act}\ HHV_{Dry}$, or $m_{As\text{-}Fired/theor}HHV=m_{DryFuel/theor}HHV_{Dry}$. Also the following equalities relating fuel energies, are important when correcting the L Factor to wet fuel conditions: $x_{MAF\text{-}theor}N_{MAF\text{-}Fuel}HHV_{MAF}=x_{Dry\text{-}theor}N_{Dry\text{-}Fuel}HHV_{Dry}=x_{Wet\text{-}theor}N_{Wet\text{-}Fuel}HHV$. However, the dry fuel energy flow based on actual combustion is not the same as dry fuel energy flow based on theoretical combustion as required in Eqs.(72A) & (75A): $m_{DryFuel/Act}HHV_{Dry} \neq m_{DryFuel/theor}HHV_{Dry}$. Second, the US Environmental Protection Agency (EPA) requires the measurement of the actual total effluents flow from most fossil-fired systems, discussed in '711. Although reported for the EPA in volumetric flow at standard conditions, this invention teaches the conversion of measured total effluents flow to a mass-base using hot densities (not cold). This is not the same total effluents mass flow associated with theoretical combustion, on a dry-base termed $m_{DryGas/theor}$, or the wet-base $m_{WetGas/theor}$. This invention also teaches, under certain conditions, to replace the total effluents flow measurement with the system's indicated fuel flow when determining heat rate. Third, the conversion from any efficiency ($\eta$) to a heat rate (HR) is common art; for example, the system heat rate is defined as $HR_{system}=3412.1416/\eta_{system}$ where the constant converts units from Btu/hr to kilowatts, thus HR in units of Btu/kW-hr, or its equivalence.

TABLE 1

L Factors and $F_C$ Factors for Various Coal Ranks
($L_{Fuel}$ and $F_C$ in units of lbm/million-Btu, HHV in Btu/lbm)

| Coal Rank | No. of Samples | Heating Value $HHV_{MAF} \pm \Delta HHV_{MAF}$ | L Factor $L_{Fuel} \pm \Delta L_{Fuel}$ | Computed $F_C$ Factor |
|---|---|---|---|---|
| Anthracite (an) | 29 | 14780.52 ± 262.65 | 827.55 ± 1.62 | 2035 |
| Semi-Anthracite (sa) | 16 | 15193.19 ± 227.41 | 804.10 ± 0.19 | 1916 |
| Low Vol. Bituminous (lvb) | 89 | 15394.59 ± 435.54 | 792.82 ± 0.39 | 1838 |
| Med. Vol. Bituminous (mvb) | 84 | 15409.96 ± 491.21 | 786.60 ± 0.41 | 1593 |
| High Vol. A Bit. (hvAb) | 317 | 15022.19 ± 293.35 | 781.93 ± 0.98 | 1774 |
| High Vol. B Bit. (hvBb) | 152 | 14356.54 ± 304.65 | 783.08 ± 1.58 | 1773 |
| High Vol. C Bit. (hvCb) | 189 | 13779.54 ± 437.67 | 784.58 ± 1.55 | 1797 |
| Sub-Bituminous A (subA) | 35 | 13121.83 ± 355.55 | 788.25 ± 1.07 | 1867 |
| Sub-Bituminous B (subB) | 56 | 12760.63 ± 628.26 | 787.07 ± 1.13 | 1862 |
| Sub-Bituminous C (subC) | 53 | 12463.84 ± 628.26 | 788.67 ± 3.07 | 1858 |
| Lignite A (ligA) | 76 | 12052.33 ± 414.79 | 796.52 ± 1.53 | 1905 |
| Lignite B (ligB) | 25 | 10085.02 ± 180.09 | 765.97 ± 2.11 | 1796 |

This invention teaches that first correcting $L_{Fuel}$ from conditions associated with theoretical combustion to actual conditions, and then dividing the corrected $L_{Fuel}$ into the measured total effluents mass flow rate, the total fuel energy flow, $m_{As\text{-}Fired}$ (HHVP+HBC), is then derived (termed the "As-Fired" fuel energy flow).

$$m_{As\text{-}Fired}(HHVP+HBC)=10^6\Xi_{Gas}m_{DryGas/Act}/[L_{Fuel}\Xi_{AF}] \quad (81)$$

where the units of mass flow (m) are lbm/hr, corrected heating value (HHVP) and Firing Correction (HBC) in Btu/lbm, and the L Factor in lbm/million-Btu. $\Xi_{Gas}$ and $\Xi_{AF}$ are unitless correction factors and discussed below.

From Eq.(81) As-Fired fuel mass flow may then be determined if heating value and the Firing Correction have been determined:

$$m_{As\text{-}Fired}=10^6\Xi_{Gas}m_{DryGas/Act}/[L_{Fuel}\Xi_{AF}(HHVP+HBC)] \quad (82)$$

As is common art for an electric power plant, dividing $m_{As\text{-}Fired}$(HHVP+HBC) by the total useful output, denoted as P in kilowatts, see '711 Eq.(1), system heat rate (also termed "gross unit heat rate" or "gross heat rate") is then determined by invoking Eq.(81). A "net heat rate" may also be determined for any heat rate relationship taught herein by replacing P with P minus House Load; the House Load being the system's internal consumption of power.

$$HR_{system}=10^6\Xi_{Gas}m_{DryGas/Act}/[L_{Fuel}\Xi_{AF}P] \quad (83)$$

'711 teaches the determination and use of HHVP and HBC. Alternatively, for situations where heating value may be reasonably estimated the methods of '711, developing HHVP from first principles, need not apply. Further, the HBC term could be assumed to have negligible effect and thus taken as zero, computed using '711 procedures, or estimated and/or held constant. HBC and HHVP are included here to illustrate consistency with '711 and '198. The $L_{Fuel}$ parameter is typically based on an uncorrected heating value, HHV, thus requiring a HHV/(HHVP+HBC) correction within the $\Xi_{AF}$ term, see Eqs.(84A), (84B) & (84C). The corrected heating value, HHVP, defined in '711, could be used to develop $L_{Fuel}$, but is not preferred.

In Eqs.(81), (82) & (83), $\Xi_{Gas}$ is a correction factor for measurement error in the total effluents flow. As a defined thermodynamic factor addressing conceptual corrections, $\Xi_{AF}$ principally converts conditions associated with theoretical combustion to those associated with the actual (As-Fired) conditions, thus allowing the use of the L Factor to monitor actual conditions. The combined $L_{Fuel}\Xi_{AF}$ expression is termed the corrected L Factor, that is, producing actual total effluents mass flow divided by the actual As-Fired fuel energy flow, and which is normalized to the bases of efficiency used at a given facility. For example, if the power plant uses HHV, then the term HHV/(HHVP+HBC) would not appear in Eqs.(84A), (84B) or (84C); if only HHVP is used then the term HHV/HHVP would appear. This is termed the correction for the system heating value base. Use of (HHVP+HBC) as a bases is preferred.

$$\Xi_{AF}=[m_{DryGas/Act}m_{WetFuel/theor}/(m_{DryGas/theor}m_{As\text{-}Fired})]HHV/(HHVP+HBC) \quad (84A)$$

$$\Xi_{AF}=[q_{DryGas/Act}\rho_{DryGas/Act}m_{WetFuel/theor}/(q_{DryGas/theor}\rho_{DryGas/theor}\cdot m_{As\text{-}Fired})]\cdot HHV/(HHVP+HBC) \quad (84B)$$

$$\Xi_{AF/Gas}=(q_{DryGas/Act}/m_{As\text{-}Fired})(m_{WetFuel/theor}/m_{DryGas/theor})HHV/(HHVP+HBC) \quad (84C)$$

Eqs.(84A) and (84B) are equivalent, however Eq.(84B) is presented to indicate a conversion of total effluents mass flow to volumetric flow, where $q_{DryGas/Act}$ and $q_{DryGas/theor}$ are dry-base volumetric flows associated with actual and theoretical combustion. Eq.(84B) illustrates the importance of considering compatible gaseous densities, $\rho_{DryGas/Act}$ and $\rho_{DryGas/theor}$, whereas if not applied consistently, or assumed the same thus cancelling, could possible incorrectly bias $\Xi_{AF}$. Eq.(84C) may be employed if the effluent flow is expressed in terms of volumetric flow; if used, $\Xi_{AF/Gas}$ carries the units of $ft^3$-Dry Gas/lbm-As-Fired fuel.

Although $L_{Fuel}$ is based on dry fuel energy flow associated with theoretical combustion, the ratio $m_{DryFuel/theor}/m_{DryFuel/Act}$ is equivalent to the ratio $m_{WetFuel/theor}/m_{As\text{-}Fired}$, allowing $\Xi_{AF}$ of Eq.(84A) or (84B) to correct the denominator of $L_{Fuel}$ such that its bases is the As-Fired (actual, wet) fuel conditions.

When the total effluents flow is measured on a wet-base, $m_{WetGas/Act}$, $L_{Fuel}$ is further corrected with the term $(1-WF_{H2O})$, where $WF_{H2O}$ is the weight fraction of moisture determined to be in the wet total effluents. The factor $(1-WF_{H2O})$ converts the $L_{Fuel}$'s numerator from a dry-base to a wet-base expression of the total effluents mass. The preferred embodiment is to use a dry-base total effluents which involves less uncertainty given possible inaccuracies in determining $WF_{H2O}$. However, $WF_{H2O}$ may be determined by measurement of the volume (molar) concentration of effluent moisture and converting to mass-base, or through computer simulation of the system or otherwise estimated. As applied: $\Xi_{AF/Wet}=\Xi_{AF}/(1-WF_{H2O})$, the corrected L Factor then being the quantity $L_{Fuel}\ \Xi_{AF/Wet}$. This correction is termed conversion to a wet-base L Factor.

'711 teaches that turbine cycle energy flow (termed BBTC, having typical units of Btu/hr) may be used to compute As-Fired fuel flow, via its Eq.(21). However, this may also be used to overcheck the above Eq.(82)'s fuel flow, or Eq.(81)'s fuel energy flow, given a determined boiler efficiency.

$$m'_{As\text{-}Fired}=BBTC\Xi_{TC}/[\eta_{Boiler}(HHVP+HBC)] \quad (85A)$$

$$m'_{As\text{-}Fired}(HHVP+HBC)=BBTC\Xi_{TC}/\eta_{Boiler} \quad (85B)$$

Boiler efficiency may be determined by: 1) estimation by the power plant engineer; 2) methods of '711; 3) held constant; 4) determined using the methods of the American Society of Mechanical Engineers (ASME), Performance Test Codes 4.1 or 4; 5) the methods described in the technical paper: F. D. Lang, "Monitoring and Improving Coal-Fired Power Plants Using the Input/Loss Method—Part III", ASME, 2000-IJPGC-15079 (CD), July 2000; 6) the methods described in the technical paper: T. Buna, "Combustion Calculations for Multiple Fuels", ASME Diamond Jubilee Annual Meeting, Chicago, Ill., Nov. 13–18, 1955, Paper 55-A-185; or 7) the methods described in the technical paper: E. Levy, et al., "Output/Loss: A New Method for Measuring Unit Heat Rate", ASME, 87-JPGC-PWR-39, October 1987.

The term $\Xi_{TC}$ is a factor chosen such that the computed fuel flow from Eq.(85A), $m'_{As\text{-}Fired}$, and that of Eq.(82) have reasonable agreement. An alternative approach is to choose $\Xi_{TC}$ of Eq.(85B) such that the computed fuel energy flow, $m'_{As\text{-}Fired}$ (HHVP+HBC), and that of Eq.(81) have reasonable agreement. For the typical power plant situation, the greatest uncertainty in these relationships, or in Eq.(21) of '711, lies with the turbine cycle energy flow, BBTC; provided HHVP (or HHV) is known. Thus the factor $\Xi_{TC}$ is used to adjust and correct the BBTC quantity until fuel flow, and/or fuel energy flow, from the two methods have reasonable agreement. Broadly, $\Xi_{TC}$ is a general correction to the turbine cycle energy flow; however errors in boiler efficiency and/or heating value are also addressed. The advantage of this technique lies in its foundation with the demonstrated consistency of the L Factor. This invention teaches that such comparisons are possible since Eqs.(85A) & (82), and Eqs.(85B) & (81), are independently developed having completely different bases. With adjustments using $\Xi_{TC}$, the turbine cycle heat rate may be determined:

$$HR_{turbine\text{-}cycle}=BBTC\Xi_{TC}/P \quad (86)$$

The L Factor method may be further extended to eliminate the requirement to measure total effluents flow, replaced with a fuel flow measurement. This may be accomplished by simplification of $\Xi_{AF}$ to the following given cancellation of the $m_{DryGas/Act}$ term; see Eqs.(83) & (84A), reduced to Eq.(87A). Also, anticipating the cancellation of volumetric flow measurement of effluent flow, and use of the $F_C$ Factor, Eq.(84C) may be used to develop Eq.(87B):

$$\Xi_{FG}=(m_{WetFuel/theor}/m_{DryGas/theor})HHV/(HHVP+HBC) \quad (87A)$$

$$\Xi_{FG/Fuel}=(m_{WetFuel/theor}/m_{As\text{-}Fired})]HHV/(HHVP+HBC) \quad (87B)$$

Thus, using Eq.(87A):

$$m_{As\text{-}Fired}(HHVP+HBC)=10^6\Xi_{Fuel}m_{AF/On\text{-}L}/[L_{Fuel}\Xi_{FG}] \quad (88)$$

$$m_{As\text{-}Fired}=10^6\Xi_{Fuel}m_{AF/On\text{-}L}/[L_{Fuel}\Xi_{FG}(HHVP+HBC)] \quad (89)$$

$$HR_{system}=10^6\Xi_{Fuel}m_{AF/On\text{-}L}/[L_{Fuel}\Xi_{FG}P] \quad (90)$$

where the quantity $\Xi_{FG}$ may be computed explicitly knowing only the fuel chemistry, the correction for the system heating value base, and assuming theoretical combustion. In Eqs.(88), (89) & (90), $\Xi_{Fuel}$ is a correction factor for measurement error in the unit's indicated As-Fired fuel flow measurement, termed $m_{AF/On\text{-}L}$. The advantage of using $\Xi_{FG}$, and Eqs.(88), (89) & (90), lies when the fuel flow measurement, although typically not accurate in coal-fired plants, is a consistent measurement, thus correctable through $\Xi_{Fuel}$. Further, the $\Xi_{FG}$ quantity is constant for a given fuel, and easily calculated. Although Eq.(90) reduces to $[m_{As\text{-}Fired/Act}$ (HHVP+HBC)/P], the classical definition of $HR_{system}$, Eq.(90) is composed of quantities which could be measured on-line if having the necessary consistently (in the system's indication of fuel flow, $m_{AF/On\text{-}L}$, and P). It also has usefulness to check the measured total effluents flow by equating Eqs.(81) and (88) and solving for $m_{DryGas/Act}$. Eq.(90) has applicability for fuels with highly variable water and ash contents, but where $L_{Fuel}$ is constant (as has been demonstrated in Table 1, e.g., lignite fuels). Eq.(89) may also be used for checking the indicated fuel flow, or fuel energy flow via Eq.(88), with the tested or observed quantity.

Additionally, this invention is not limited by the above presentations. Heating value could be computed using Eqs. (81) and (85A), or Eq.(88), provided fuel flow is independently determined. The preferred embodiment of this invention is to use the L Factor, and when off-line, Eqs.(81), (82) & (83).

Evaluating the $\Xi_{AF}$ and $\Xi_{FG}$ Corrections

As taught by this invention if heat rate of a fossil-fired system is to be evaluated using the methods of this invention, the correction terms $\Xi_{AF}$, $\Xi_{AF/Gas}$, $\Xi_{FG}$ or $\Xi_{FG/Fuel}$, must be determined. Several of these terms employ the ratio $m_{WetFuel/theor}/m_{DryGas/theor}$. This ratio is equal to $x_{Wet\text{-}theor}N_{Wet\text{-}Fuel}/(100N_{WetGas/theor})$, computed using Eq. (80) assuming wet-base quantities. Eq.(80), based on theoretical combustion, may be evaluated knowing only the fuel's chemistry. The $\Xi_{AF}$ term contains the ratio $(m_{DryGas/Act}/m_{As\text{-}Fired})$ which is equal to the quantity $[(1.0+AF_{Wet/Act})/(1.0-WF_{H2O}-WF_{Ash})]$, where: $AF_{Wet/Act}$ is the system's actual Air/Fuel ratio, $WF_{H2O}$ is the wet-base effluent moisture weight fraction, and $WF_{Ash}$ is the wet-base effluent ash weight fraction. The ratio $m_{WetFuel/theor}/m_{As\text{-}Fired}$ is also used which may be evaluated as unity if the system employs low excess combustion oxygen, or computed as the ratio: $(\eta_{Boiler}/\eta_{Boiler/theor})$; where $\eta_{Boiler}$ is the actual boiler efficiency and $\eta_{Boiler/theor}$ the boiler efficiency assuming theoretical combustion. $\eta_{Boiler}$ may be computed from any accurate method which is not dependent on any measured flow (i.e., fuel, air, total effluents nor working fluid); examples of such methods are discussed following Eq. (85B). $\eta_{Boiler/theor}$ may be computed using these same methods, but assuming theoretical combustion. These correction terms may also be determined by assumption, estimation or gathering from a data base associated with historical combustion air flow and/or fuel flow determinations.

The F Factor

The following discusses the EPA's F Factor in light of its use in determining the L Factor, fuel energy flow and system heat rate. Using the $F_C$ Factor the emission rate for dry gaseous total effluents assuming theoretical combustion is given by Eq.(91A) or Eq.(91B), which are alternative methods for computing the L Factor, but with less accuracy. A validity test for use of the $F_C$ Factor lies in whether Eq.(91A) produces the same values as obtained from Eqs.(72A) or (75A); and, furthermore, whether these values are at least as consistent as observed with actual fuel data, and especially for coal data as observed in Table 1. The L Factor as computed from the $F_C$ Factor is herein termed $L_{Fuel/EPA}$. $L_{Fuel/EPA}$ is corrected with the $\Xi_{AF}$ or $\Xi_{FG}$ term as taught above, resulting in a corrected L Factor.

$$L_{Fuel/EPA}=100N_{DryGas/theor}F_C/(385.231d_{theor});\ lbm\text{-Dry Gas/million-Btu} \quad (91A)$$

$$L_{Fuel/EPA}=100F_C/d_{theor};\ ft^3\text{-DryGas/million-Btu} \quad (91B)$$

$N_{DryGas/theor}$ is the molecular weight of the dry gaseous total effluents assuming theoretical combustion, and $d_{theor}$ is the concentration of $CO_2$ at the system's boundary on a dry-base (in percent) given theoretical combustion. Reference should be made to '198 and '711 for encompassing stoichiometrics. It is instructive to examine the units of Eqs.(91A) and (91B); note that in the following "Dry Gas" refers to the total effluents assuming theoretical combustion, and, for clarity, assume a volume base replaces molar quantities. $F_C$ carries units of $ft^3$-$CO_2$/million-Btu. If $L_{Fuel/EPA}$ is used conventionally, that is with units of lbm-Dry Gas/million-Btu, applicable units for Eq.(91A) are:

$$lbm\text{-Dry Gas/million-Btu}\ [=][(100\ ft^3\text{-Dry Gas/base})\ (lbm\text{-Dry Gas}/lbm\text{-mole Dry Gas})(ft^3\text{-}CO_2/\text{million-Btu})]/[(385.321\ ft^3\text{-Dry Gas}/lbm\text{-mole Dry Gas})\cdot\{(ft^3\text{-}CO_2/ft^3\text{-Dry Gas})(100\ ft^3\text{-Dry Gas/base})\}]$$

Alternatively, if $L_{Fuel/EPA}$ is used with units of $ft^3$-Dry Gas/million-Btu, applicable units for Eq.(91B) are:

$$ft^3\text{-Dry Gas/million-Btu}\ [=][(100\ ft^3\text{-Dry Gas/base})(ft^3\text{-}CO_2/\text{million-Btu})]/\{(ft^3\text{-}CO_2/ft^3\text{-Dry Gas})(100\ ft^3\text{-Dry Gas/base})\}$$

These presentations reveal that inclusion of the gas molecular weight is necessitated for units consistency for Eq.(91A). Note that the 385.321 volume to molar conversion is applicable for either dry or wet gas if ideal gas laws may be applied, and as required by the choice of the molecular weight being either dry- or wet-base. These presentations also teach that $F_C$ must be divided by the $CO_2$ concentration (the last term in {braces}) such that units of $ft^3$-$CO_2$ cancel. The units of $F_C$ and the constant 385.321 are associated with simple ideal gas conversions, without consideration nor dependency on the actual combustion process. The $CO_2$ concentration is associated with theoretical combustion, $d_{theor}$. The results of (91A) or (91B) is lbm or $ft^3$ of dry gas associated with theoretical combustion per million Btu of fuel; thus these presentations teach the need for a correction from the theoretical to the actual via the term $\Xi_{AF}$. The EPA factor $F_D$, employing dry-base effluent $O_2$, and the factor $F_W$ employing wet-base effluent $O_2$, require similar treatment.

The $F_C$, $F_D$ or $F_W$ factors may be determined: 1) by computation based on fuel chemistry using EPA procedures; 2) by using constant values as suggested by the EPA for certain fuels; or 3) by using $F_C$ values from Table 1. The bases and general accuracy of the F Factors is discussed in the technical paper: F. D. Lang and M. A. Bushey, "The Role of Valid Emission Rate Methods in Enforcement of the Clean Air Act", *Proceedings of Heat Rate Improvement Conference,* Baltimore, Md., sponsored by Electric Power Research Institute, May 1994 (also published in: *FLOWERS '94: Proceedings of the Florence World Energy Research Symposium,* editor E. Carnevale, Servizi Grafici Editoriali, Padova, Italy 1994). Lang and Bushey used the symbol $\beta_{CO2\text{-}dry}$ for $d_{Act}$ (as used here and in '711), and E for emission rate whereas ER is used here and in '711.

EPA regulations rely on F Factors to describe the dry pounds of the total effluents per million-Btu of fuel burned, for actual conditions found at any stationary source of fossil combustion. This may be adequate for EPA's environmental protection policies; it is not accurate compared to this invention's use of L Factor methodology and $L_{Fuel}$ based on Eqs.(72A) or (75A). This invention teaches by the very nature of the F Factor formulation used by the EPA, errors must be realized when these uncorrected factors are employed for actual combustion situations. As found in the course of developing this invention, the definition of the L Factor intrinsically involves effluent water and effluent ash, see Eq.(72A); $F_C$, $F_D$ or $F_W$ factors do not, they are simple conversions of fuel to effluents using ideal gas assumptions, without consideration of basic combustion. The effects of differing water (both entrapped and that created from combustion) and ash contents associated with hydrocarbon fuels, being subtracted from fuel and combustion air terms of Eq.(72A), are conceptually important. These effects are addressed by this invention. Use of an F Factor derived without consideration of basic combustion, results in an inaccurate L Factor. For example, $L_{Fuel}$ for average hvAb coal based on 317 samples is 781.93 lbm/million-Btu, while $L_{Fuel/EPA}$ is 773.81 or 1.05% difference; the standard deviation for this large sample size is only 0.13% based on Eq.(72A). The error in $L_{Fuel/EPA}$ amounts to over 100 ΔBtu/kW-hr in system heat rate.

Table 2 presents typical sensitivities of $L_{Fuel}$ and $\Xi_{AF}$ for actual combustion situations. In Table 2 the $R_{Act}$ term is the air pre-heater "leakage factor" discussed '711; the $A_{Act}$ term is also defined and used throughout '711, yielding $\phi_{Act}$= 3.82195 for the example; by "boiler" in the last two lines is meant the excess $O_2$ measurement is taken at the combustion gas inlet to the air pre-heater, before dilution by air pre-heater leakage. The last case studied varied the $A_{Act}$ term, thus $\phi_{Act}$, which effects the mass of dry total effluents although not the fuel per se.

TABLE 2

Typical Sensitivities of $L_{Fuel}$ and $\Xi_{AF}$ for hvAb Coal

| hvAb Case | $L_{Fuel}$, Eq.(75A) | $\Xi_{AF}$ Correction, Eqs.(84A) |
|---|---|---|
| Theoretical Combustion | 781.93 | 1.00000 |
| 1.0% excess $O_2$, $R_{Act}$ = 1.00. | 781.93 | 1.04664 |
| 2.0% excess $O_2$, $R_{Act}$ = 1.00. | 781.93 | 1.09820 |
| 3.0% excess $O_2$, $R_{Act}$ = 1.00. | 781.93 | 1.15551 |
| 3.0% excess $O_2$ (boiler), and $R_{Act}$ = 1.10 | 781.93 | 1.26410 |
| 3.0% excess $O_2$ (boiler), $R_{Act}$ = 1.10, and $A_{Act}$ = 0.207385. | 781.93 | 1.27821 |

If F Factors are to be used to produce the L Factor, this invention teaches that, for example, Eq.(91A) and (91B) must be used with caution, and that applying numerical bias or a determined correlation to the resulting heat rate must be considered.

The following equations apply for determining fuel flow and system heat rate based on the $F_C$ Factor, employing mass or volumetric flows.

$$m_{As\text{-}Fired}=385.321\times10^6\Xi_{Gas}m_{DryGas/Act}d_{theor}/[100N_{DryGas/theor}F_C\Xi_{AF}(HHVP+HBC)] \quad (92A)$$

$$m_{As\text{-}Fired}=385.321\times10^6\Xi_{Gas}m_{WetGas/Act}d_{theor}/[100N_{DryGas/theor}F_C\Xi_{AF/Wet}(HHVP+HBC)] \quad (92B)$$

$$m_{As\text{-}Fired}=10^6\Xi_{Gas}q_{DryGas/Act}d_{theor}/[100F_C\Xi_{AF/Gas}(HHVP+HBC)] \quad (92C)$$

$$m_{As\text{-}Fired}=10^6\Xi_{Gas}m_{DryGas/theor}d_{theor}/[100F_C\Xi_{FG/Fuel}(HHVP+HBC)] \quad (92D)$$

$$HR_{system}=385.321\times10^6\Xi_{Gas}m_{DryGas/Act}d_{theor}/[100N_{DryGas/theor}F_C\Xi_{AF}P] \quad (93A)$$

$$HR_{system}=385.321\times10^6\Xi_{Gas}m_{WetGas/Act}d_{theor}/[100N_{DryGas/theor}F_C\Xi_{AF/Wet}P] \quad (93B)$$

$$HR_{system}=10^6\Xi_{Gas}q_{DryGas/Act}d_{theor}/[100F_C\Xi_{AF/Gas}P] \quad (93C)$$

$$HR_{system}=10^6\Xi_{Gas}m_{DryGas/theor}d_{theor}/[100F_C\Xi_{FG/Fuel}P] \quad (93D)$$

In these relationships, $m_{DryGas/Act}$ or $m_{WetGas/Act}$ are the dry-base or wet-base mass flow rates (lbm/hour) of total effluents, $q_{DryGas/Act}$ or $q_{WetGas/Act}$ are the volumetric flow rates ($ft^3$/hour), $d_{theor}$ is the $CO_2$ effluent concentration on a dry-base assuming theoretical combustion, $N_{DryGas/theor}$ is the molecular weight of the dry-base total effluents assuming theoretical combustion, and $WF_{H2O}$ is the actual wet-base weight fraction of effluent $H_2O$ consistent with the determination of $m_{WetGas/Act}$. $m_{DryGas/Act}$ could be substituted with $q_{DryGas/Act}\rho_{DryGas}$ if volumetric flow is measured; or $m_{WetGas/Act}$ could be substituted with $q_{WetGas/Act}\rho_{WetGas}$. Use of (HHVP+HBC) in Eq.(92), versus simply HHV, or HHVP, is dependent on the chosen bases of system heating value base as discussed above. Multiplying both sides of Eq.(92) by (HHVP+HBC) produces total fuel energy flow as in Eq.(81). Eqs. of (93) states that heat rate is directly proportional to the total effluents flow and the $CO_2$ concentration associated with theoretical combustion, and inversely proportional to $F_C$ and electrical power (kilowatts). These equations may be repeated using the $F_W$ and $F_D$ Factors, also described and allowed by 40 CFR Part 60, Appendix A, Method 19. $\Xi_{Gas}$ may be taken as unit for Eq.(92D) & (93D) or otherwise determined.

The $F_D$ and $F_W$ Factors may be employed in similar relationships as taught herein. The above equations represent varieties of relationships involving the $F_C$ Factor and corrections, others may be developed based on these teachings. Although the preferred embodiment involves use of the L Factor directly, if the $F_C$ Factor is to be used then Eqs.(92D) and (93D) are preferred since the computation of the $\Xi_{FG/Fuel}$ is most direct and accurate, involving the ratio ($\eta_{Boiler}/\eta_{Boiler/theor}$), as taught above. Further, the quantity ($m_{DryGas/theor}d_{theor}$) used in Eqs.(92D) & (93D) may be determined from theoretical combustion knowing only the fuel chemistry.

On-Line Monitoring

The following presents a factor similar to $\Xi_{AF}$, termed $\Xi_{On\text{-}L}$, which is applied for on-line monitoring and may be determined from routine system operational data. Thus $\Xi_{On\text{-}L}$ may be substituted for $\Xi_{AF}$ to achieve on-line monitoring of heat rate. By on-line monitoring is meant the analysis of plant data using the methods of this invention in essentially real time, and/or simply the acquisition of plant data.

As taught, the L Factor requires corrections to the actual, from total effluents and fuel flows associated with theoretical combustion. The total effluents flow correction is developed by first dividing all terms of Eq.(80) by $x_{Dry\text{-}theor}N_{Dry\text{-}Fuel}$, thus developing an Air/Fuel ratio (termed $AF_{Dry\text{-}theor}$), and then substituting $L_{Fuel}$ from Eq.(75A):

$$1.0+AF_{Dry\text{-}theor}-(J_{theor}N_{H2O}+x_{MAF\text{-}theor}\alpha_{MAF\text{-}10}N_{Ash})/(x_{Dry\text{-}theor}N_{Dry\text{-}Fuel})=10^{-6}L_{Fuel}HHV_{Dry} \quad (94)$$

The Air/Fuel ratio is the ratio of the mass flow of combustion air to the mass flow of the As-Fired fuel. The terms in Eq.(94) involving effluent moisture and ash may be expressed as fuel weight fractions given theoretical combustion. However, since only the influence of dry total effluents on $L_{Fuel}$ is desired it has been found that only the As-Fired weight fraction of ash needs to be considered in practice:

$$1.0+AF_{Dry\text{-}theor}-WF_{Ash}\approx10^{-6}L_{Fuel}HHV_{Dry} \quad (95)$$

or simplifying using a constant $K_1$ (=1.0−$WF_{Ash}$), descriptive of a given fuel:

$$K_3AF_{Wet\text{-}theor}+K_1=10^{-6}L_{Fuel}HHV_{Dry} \quad (96)$$

where $K_3$ is a conversion from dry-base to wet-base for theoretical combustion. $L_{Fuel}HHV_{Dry}$ is approximately constant for any operation burning the same fuel, even though the fuel's water content may vary considerably (as it does commonly with poorer quality coals). Thus the ratio of indicated system wet Air/Fuel ratio to the wet Air/Fuel ratio associated with theoretical combustion, addresses the correction for total effluents flow. The correction for fuel flow is addressed as the ratio of the system's indication of As-Fired fuel flow ($m_{AF/On\text{-}L}$) to the wet fuel flow associated with theoretical combustion ($m_{WetFuel/theor}$).

The following functionality has been found to yield good results while monitoring a system on-line, when the total effluents flow is being measured:

$$\Xi_{On\text{-}L}=[K_2(AF_{Wet/On\text{-}L}+K_1)m_{AF/On\text{-}L}]HHV/(HHVP+HBC) \quad (97)$$

It has been found in practice that the system engineer may determine $K_1$ and $K_2$ quickly by adjustments to his/her on-line monitoring routines, on-line monitoring software, or to the plant's data acquisition computer, or by estimation. To determine reasonable initial estimates: $K_1$ may be computed as taught above; $K_2=1.0/[(K_3AF_{Wet\text{-}theor}+K_1)\ m_{WetFuel/theor}]$ as based on theoretical combustion, and requiring adjustment for the type of flow being monitored either mass-base or volume-base (e.g., the conversion factor 385.321 $ft^3$/lb-mole at standard conditions); and where $K_3$=1.0. Eq.(97) employs the system's on-line measurements of Air/Fuel ratio ($AF_{Wet/On\text{-}L}$), and the As-Fired fuel flow ($m_{AF/On\text{-}L}$). Eq.(97) could also be expressed in terms of the actual combustion air flow measurement, $m_{Air/On\text{-}L}$:

$$\Xi_{On\text{-}L}=[K_2(m_{Air/On\text{-}L}+K_1m_{AF/On\text{-}L})]HHV/(HHVP+HBC) \quad (98)$$

Finally, the methods of this invention may be applied on-line using the following equations. In Eq.(99) $q_{DryGas/Act}$ is the measured dry total effluents volumetric flow, typically reported by system instruments in units of $ft^3$/hour. If the total effluents flow is reported as a mass flow then Eqs.(81), (82) and (83), would apply replacing $\Xi_{AF}$ with $\Xi_{On\text{-}L}$. The effluent density, termed ρ, must be consistent with the measurement base of the volumetric flow. The preferred embodiment, if using Eqs.(99) or (100), is the use of hot flows with hot densities. The combined $L_{Fuel}\Xi_{On\text{-}L}$ expression is termed the corrected L Factor.

$$HR_{system}=10^6\Xi_{Gas}q_{DryGas/Act}\rho_{DryGas}/[L_{Fuel}\Xi_{On\text{-}L}P] \quad (99)$$

$$HR_{system}=10^6\Xi_{Gas}q_{WetGas/Act}\rho_{WetGas}(1-WF_{H2O})/[L_{Fuel}\Xi_{On\text{-}L}P] \quad (100)$$

Thus the L Factor may be corrected to a dry-base or wet-base, reflecting the nature of the total effluents considered. To illustrate the accuracy of the L Factor method Table 3 presents results of using several of the procedures discussed. Its accuracy is considered exceptional.

TABLE 3

Typical Heat Rate Results for High Volatile A Bituminous (hvAb) Coal (using $\Xi_{AF}$ from Table 2, $\Xi_{On-L}$ via Eq.(97), $\Xi_{Gas}$ = 1.000)

| hvAb Case | Measured System Heat Rate (Btu/kW-hr) | L Factor Heat Rate, Off-Line Eq.(83) | L Factor Heat Rate, On-Line Eq.(99) |
|---|---|---|---|
| Theoretical Combustion | 8436 | 8436 | 8436 |
| 1.0% excess $O_2$, $R_{Act}$ = 1.00. | 8452 | 8452 | 8455 |
| 2.0% excess $O_2$, $R_{Act}$ = 1.00. | 8471 | 8469 | 8474 |
| 3.0% excess $O_2$, $R_{Act}$ = 1.00. | 8491 | 8488 | 8483 |
| 3.0% excess $O_2$ (boiler), and $R_{Act}$ = 1.10 | 8530 | 8526 | 8526 |
| 3.0% excess $O_2$ (boiler), $R_{Act}$ = 1.10, and $A_{Act}$ = 0.207385. | 8535 | 8530 | 8529 |

To apply the $F_C$ Factor to the on-line monitoring of a power plant the following equations apply for either dry- or wet-base quantities:

$$HR_{system}=385.321\times10^6\Xi_{Gas}q_{DryGas/Act}\rho_{DryGas}d_{theor}/[100N_{DryGas/theor}F_C\Xi_{On-L}P] \quad (101)$$

$$HR_{system}=10^6q_{DryGas/theor}d_{theor}/[100F_C\Xi_{On-L/Fuel}P] \quad (102)$$

It has been found that the factor $\Xi_{On-L/F}$, suggested by the factor $\Xi_{On-L}$ discussed above, may be resolved via Eq. (103A). The factor $\Xi_{On-L/Fuel}$ is suggested by $\Xi_{FG/Fuel}$ and its discussion, and thus may be resolved via Eq.(103B).

$$\Xi_{On-L/F}=[K_{2F}(AF_{Wet/On-L}+K_{1F})m_{AF/On-L}]HHV/(HHVP+HBC) \quad (103A)$$

$$\Xi_{On-L/Fuel}=(\eta_{Boiler}/\eta_{Boiler/theor})HHV/(HHVP+HBC) \quad (103B)$$

where the factors $K_{2F}$ and $K_{1F}$ are adjusted such that the system operator's observations and those produced from Eq.(101) or (102) have reasonable agreement. The factor $K_{1F}$ may be computed as taught for $K_1$, or otherwise determined; it generally may be held constant. The factor $K_{2F}$ is typically estimated or otherwise determined, and may include functionalities related to moisture in the total effluents, As-Fired fuel moisture, addresses different flow measurements (volumetric- or mass-base), and/or a correlation which adjusts the Air/Fuel ratio using operational parameters. In practice, for a given thermal system, the factor $K_{2F}$ is developed as a variable, having at least functionality with a measured moisture in the total effluents. The preferred embodiment of this invention is to use the L Factor, and when on-line, Eqs. (99) & (100).

Emission Rates of Pollutants

The ability to compute As-Fired fuel flow based on the L Factor, as taught by this invention, allows the determination of pollutant emission rates (ER) typically required for regulatory reporting. As taught in '711, and its Eq.(70B) and associated discussion, the emission rate of any effluent species may be determined by knowing its molar fraction (i.e., its concentration) within the total effluents, molecular weight of the species and the moles of fuel per mole of effluent. The procedure for calculating emission rates may be greatly simplified using the L Factor, which also results in increased accuracy.

This invention includes the following relationship to calculate the emission rate of any species:

$$ER_i=L_{Fuel}\Xi_{AF}\Phi_{Dry-i}N_i/[100N_{DryGas/Act}] \quad (104)$$

where $\Phi_{Dry-i}$ is the dry-base molar concentration of species i (in percent), $N_i$ is the species' molecular weight, and $N_{DryGas/Act}$ (or $N_{WetGas/Act}$) is the molecular weight of the dry (or wet) total effluents for actual combustion. When on-line, the molecular weight of the total effluents, $N_{WetGas/Act}$ or $N_{DryGas/Act}$, may be held constant or computed knowing the fuel's chemistry and operating parameters as is discussed in '711 and '198. As an example, for $SO_2$ effluent using the nomenclature of '711, see Eq.(29) of '711: $\Phi_{Dry-SO2}$=k.

For any effluent measured on a wet-base ($\Phi_{Wet-i}$):

$$ER_i=L_{Fuel}\Xi_{AF/Wet}\Phi_{Wet-i}N_i/(100N_{WetGas/Act}) \quad (105)$$

The preferred embodiment is to use Eq.(104) which involves less uncertainty given possible inaccuracies in determining $WF_{H2O}$, discussed above. The factor $\Xi_{AF}$ is defined by Eq.(84A). The factor $\Xi_{On-L}$ may be substituted for $\Xi_{AF}$ in Eqs.(104) and (105) as taught in Eqs.(97) and (98).

The accuracy of using the L Factor for computing emission rates is demonstrated by the L Factor's ability to match measured system heat rates (see above table). The L Factor may track operational changes, whereas the F Factor requires numerical bias or contrived correlations. As reported by Lang & Bushey, errors in emission rates based on the F Factor may exceed 10% for certain fuels, with common errors of 3%. The preferred embodiment of this invention when determining emission rates is to use the L Factor as taught by Eqs. (104) & (105), replacing EPA methods.

To improve how the US EPA determines emission rates the following relationship is herein taught. Improvements to EPA methods include the recognition that $F_C$ is based on theoretical combustion, not actual, and that the terms $N_{DryGas/theor}$, $\Xi_{AF}$, and $d_{theor}$ used in Eq.(106) corrects for this assumption.

$$ER_i=N_{DryGas/theor}F_C\Xi_{AF}\Phi_{Dry-i}N_i/(385.321d_{theor}N_{DryGas/Act}) \quad (106)$$

Further use of various forms of the L Factor and the F Factors as taught herein involving dry-base, wet-base, volumetric or mass flow rates can be applied to the determination of emission rates.

The Drawing

FIG. 1 illustrates an important portion of this invention, the determination of system heat rate associated with a fossil fueled power plant. Box 303 depicts the calculation of the L Factor defined by Eqs. (72A) or (75A), or otherwise determined as discussed herein, including the use of Eq. (91A) or (91B) if applicable, including the use of Table 1. If Table 1 L Factors are used, the preferred embodiment of this invention is to use these factors within a 1% range of their mean value as presented in Table 1 for any given Rank of coal; said Rank being defined by ASTM standards such as D388, or similar standards; said Rank requiring knowledge of the coal's chemistry and other properties. Thus if such L Factors are to be employed, establishing the L Factor for the anthracite coal between 819.36 and 835.83 lbm/million-Btu, or establishing the L Factor for the semi-anthracite coal between 796.14 and 812.14 lbm/million-Btu, or establishing the L Factor for the low volatile bituminous coal between 784.97 and 800.75 lbm/million-Btu, or establishing the L Factor for the medium volatile bituminous coal between 778.81 and 794.47 lbm/million-Btu, or establishing the L Factor for the high volatile A bituminous coal between 774.19 and 789.75 lbm/million-Btu, or establishing the L Factor for the high volatile B bituminous cola between 775.33 and 790.91 lbm/million-Btu, or establish the L Factor for the high volatile C bituminous coal between 776.82 and 792.43 lbm/million-Btu, or establishing the L Factor for the sub-bituminous A coal between 780.45 and 796.14 lbm/million-Btu, or establishing the L Factor for the sub-bituminous B coal between 779.28 and 794.94 lbm/million-Btu, or establishing the L Factor for the sub-bituminous C coal between 780.86 and 796.56 lbm/million-Btu, or establishing the L Factor for the lignite A coal between 788.63 and 804.49 lbm/million-Btu, or establishing the L Factor for the lignite B coal between 758.39 and 773.63 lbm/million-Btu.

Box 301 depicts the measurement of electrical generation produced by the thermal system. Box 305 depicts the calculation of a correction to the L Factor, the term $\Xi_{AF}$, $\Xi_{AF/Wet}$, $\Xi_{AF/Gas}$, $\Xi_{FG}$ or $\Xi_{FG/Fuel}$ defined by Eqs.(84A), (84B), (84C), (87A) or (87B), or otherwise determined as discussed herein, including dry-base to wet-base conversions. Box 307 depicts the multiplication of the L Factor by the correction to the L Factor. Box 309 depicts the determination of the total effluents flow from fossil combustion. Box 311 depicts the determination of a correction factor to the determined total effluents flow, termed $\Xi_{Gas}$, and its consistent use with either a mass or volume, dry-base or wet-base, total effluents flow measurement. Box 313 depicts the multiplication of the total effluents flow by its correction factor. Box 315 depicts the calculation of the system's total fuel energy flow as taught, for example, through Eqs.(81), (88), and/or the discussion pertaining to Eqs.(92). Box 317 depicts the calculation of the heat rate of the system as taught, for example, thought Eqs.(83), (90), (93), (99) and/or (100).

For FIG. 1 and elsewhere herein, if used, the words "obtain", "obtained", "obtaining", "determine", "determined", "determining" or "determination" are defined as measuring, calculating, assuming, estimating or gathering from a data base. The words "establish", "established" or "establishing" are defined as measuring, calculating, assuming, estimating or gathering from a data base. The word "total effluents" is used to mean all products resultant from the combustion of fossil fuel as found at the point where the flow rate of these combustion products is obtained, for example all effluents exiting from the smoke stack, the smoke stack being the point of flow measurement. The word "effluent" refers to a single, unique, combustion product at the point where the flow rate of all combustion products is obtained, for example $CO_2$ found in the smoke stack. Further, the words "theoretical combustion" refers to the following conditions: 1) combustion of fossil fuel with just enough oxygen that none is found in the products of combustion; and 2) complete and ideal oxidation occurs such that no pollutants are found in the products of combustion (e.g., CO, NO, $SO_3$, unburned fuel, etc. are not present). The words "theoretical combustion" and "stoichiometric combustion" mean the same. The words "adjust" or "adjusting" means to correct to a determined value. The words "reasonable agreement" mean that two parameters which are being compared, agree in their numerical values within a determined range or percent.

What is claimed is:

1. A method for quantifying the operation of a fossil-fired system, the method comprising the steps of:

obtaining an L Factor;

determining a correction to the L Factor which converts its applicability from theoretical combustion to combustion associated with the fossil-fired system, and if applicable the correction for the system heating value base, and if applicable conversion to a wet-base L Factor;

combining the L Factor and the correction to the L Factor, resulting in a corrected L Factor;

obtaining a total effluents flow rate from the fossil-fired system;

obtaining a correction factor for the total effluents mass flow rate, resulting in a corrected total effluents mass flow rate; and dividing the corrected total effluents flow rate by the corrected L Factor, resulting in a total fuel energy flow of the system.

2. The method of claim 1, wherein the step of obtaining the total effluents flow rate includes the steps of:

obtaining a total effluents volumetric flow rate from the fossil-fired system;

obtaining a density of the total effluents; and obtaining the total effluents flow rate by multiplying the total effluents volumetric flow rate by the density of the total effluents.

3. The method of claim 1, including additional steps, after the step of dividing the corrected total effluents, of:

obtaining a produced electrical power from the fossil-fired system; and dividing the total fuel energy flow of the system by the produced electrical power, resulting in a heat rate of the fossil-fired system.

4. The method of claim 1, including additional steps, after the step of dividing the corrected total effluents, of:

obtaining a fuel heating value of the fuel consumed by the fossil-fired system; and dividing the total fuel energy flow of the system by the fuel heating value, resulting in a fuel flow rate of the fossil-fired system.

5. The method of claim 4, including additional steps, after the step of dividing the total fuel energy flow, of:

obtaining a turbine cycle energy flow;

obtaining a boiler efficiency;

obtaining a turbine cycle based fuel flow rate by dividing the turbine cycle energy flow by the product of the boiler efficiency and the fuel heating value; and adjusting the turbine cycle energy flow until the turbine cycle based fuel flow rate and the fuel flow rate are in reasonable agreement.

6. The method of claim 1, including additional steps, after the step of dividing the corrected total effluents, of:

obtaining a fuel flow rate of the fossil-fired system; and dividing the total fuel energy flow of the system, by the fuel flow rate, resulting in the fuel heating value of the fuel consumed by the fossil-fired system.

7. The method of claim 6, including additional steps, after the step of dividing the total fuel energy flow, of:

obtaining a turbine cycle energy flow;

obtaining a boiler efficiency;

obtaining a turbine cycle based fuel flow heating value by dividing the turbine cycle energy flow by the product of the boiler efficiency and the fuel flow rate; and adjusting the turbine cycle energy flow until the turbine cycle based fuel heating value and the fuel heating value are in reasonable agreement.

8. The method of claim 1, wherein the step of determining the correction to the L Factor comprises the steps of:

obtaining a combustion air flow rate of the fossil-fired system by on-line monitoring;

obtaining a fuel flow rate of the fossil-fired system by on-line monitoring;

determining a correction for the system heating value base used by the fossil-fired system;

determining an on-line correction to the L Factor by combining the combustion air flow rate, the fuel flow rate and, if applicable, the correction for the system heating value base; and obtaining a corrected L Factor by combining the L Factor and the on-line correction to the L Factor.

9. The method of claim 1, wherein the step of obtaining the L Factor, includes the step of:

determining that the fossil fuel is a coal;

determining a set of properties associated with the coal;

determining a rank for the coal from the set of properties, said rank to be either an anthracite coal, or a semi-anthracite coal, or a low volatile bituminous coal, or a medium volatile bituminous coal, or a high volatile A bituminous coal, or a high volatile B bituminous coal, or a high volatile C bituminous coal, or a sub-bituminous A coal, or a sub-bituminous B coal, or a sub-bituminous C coal, or a lignite A coal, or a lignite B coal;

depending on the rank of the coal, establishing the L Factor for the anthracite coal between 819.36 and 835.83 lbm/million-Btu, or establishing the L Factor for the semi-anthracite coal between 796.14 and 812.14 lbm/million-Btu, or establishing the L Factor for the low volatile bituminous coal between 784.97 and 800.75 lbm/million-Btu, or establishing the L Factor for the medium volatile bituminous coal between 778.81 and 794.47 lbm/million-Btu, or establishing the L Factor for the high volatile A bituminous coal between 774.19 and 789.75 lbm/million-Btu, or establishing the L Factor for the high volatile B bituminous coal between 775.33 and 790.91 lbm/million-Btu, or establishing the L Factor for the high volatile C bituminous coal between 776.82 and 792.43 lbm/million-Btu, or establishing the L Factor for the sub-bituminous A coal between 780.45 and 796.14 lbm/million-Btu, or establishing the L Factor for the sub-bituminous B coal between 779.28 and 794.94 lbm/million-Btu, or establishing the L Factor for the sub-bituminous C coal between 780.86 and 796.56 lbm/million-Btu, or establishing the L Factor for the lignite A coal between 788.63 and 804.49 lbm/million-Btu, or establishing the L Factor for the lignite B coal between 758.39 and 773.63 lbm/million-Btu.

10. The method of claim 1, wherein the step of obtaining the L Factor, includes the step of:

establishing a ratio of non-oxygen gases to oxygen used for ambient air conditions which is greater than a value of 3.7619 and less than a value of 3.7893.

11. The method of claim 1, wherein the step of obtaining the total effluents flow rate includes the step of:

obtaining a total effluents mass flow rate from the fossil-fired system.

12. The method of claim 1, wherein the step of determining the correction to the L Factor includes the steps of:

obtaining a ratio of actual dry-gas effluent mass flow to actual wet fuel mass flow;

obtaining a ratio of the ratio of the theoretical wet fuel mass flow to the theoretical dry-gas effluent mass flow; and multiplying the ratio of actual dry-gas effluent mass flow to actual wet fuel mass flow by the ratio of the ratio of the theoretical wet fuel mass flow to the theoretical dry-gas effluent mass flow resulting in the correction to the L Factor.

13. The method of claim 1, wherein the step of determining the correction to the L Factor includes the steps of:

obtaining a ratio of actual dry-gas effluent volumetric flow to theoretical dry-gas effluent volumetric flow;

obtaining a ratio of the actual dry-gas density to the theoretical dry-gas density used to convert the ratio of actual dry-gas effluent volumetric flow to theoretical dry-gas effluent volumetric flow;

obtaining a ratio of the ratio of the theoretical wet fuel mass flow to the actual wet fuel mass flow; and multiplying the ratio of actual dry-gas effluent volumetric flow to theoretical dry-gas effluent volumetric flow by the ratio of the actual dry-gas density to the theoretical dry-gas density by the ratio of the ratio of the theoretical wet fuel mass flow to the actual wet fuel mass flow resulting in the correction to the L Factor.

14. The method of claim 12, wherein the step of obtaining the ratio of actual dry-gas effluent mass flow to actual wet fuel mass flow includes the steps of:

obtaining an actual air/fuel ratio;

obtaining a weight fraction of water in the fossil fuel;

obtaining a weight fraction of ash in the fossil fuel; and combining the actual air/fuel ratio, the weight fraction of water and the weight fraction of ash resulting in the ratio of actual dry-gas effluent mass flow to actual wet fuel mass flow.

15. The method of claim 12, wherein the step of obtaining the ratio of the theoretical wet fuel mass flow to the theoretical dry-gas effluent mass flow includes the steps of:

obtaining a molecular weight of the wet fuel;

obtaining a molecular weight of the wet-gas effluent based on theoretical combustion;

obtaining a ratio of the moles of wet fuel required to produce 100 moles of wet-gas effluent based on theoretical combustion; and combining the molecular weight of the wet fuel, the molecular weight of the wet-gas effluent and the ratio of the moles of wet fuel required to produce 100 moles of wet-gas effluents resulting in the ratio of the theoretical wet fuel mass flow to the theoretical dry-gas effluent mass flow.

* * * * *

UNITED STATES PATENT AND TRADEMARK OFFICE

CERTIFICATE OF CORRECTION

PATENT NO. : 6,560,563 B1
DATED : May 6, 2003
INVENTOR(S) : Fred D. Lang

It is certified that error appears in the above-identified patent and that said Letters Patent is hereby corrected as shown below:

Column 3,
Lines 9-10, should read: -- This invention is unlike the works of Munukutla and Sarunac, *et al*, in several key areas. First, as taught by this --
Lines 63-64, Equation (72A) should read:

$$L'_{Fuel} = 10^6 [x_{Dry\text{-}theor} N_{Dry\text{-}Fuel} + a_{Dry\text{-}theor} (1 + \phi_{Ref}) N_{Dry\text{-}Air} - J_{theor} N_{H2O} - x_{MAF\text{-}theor} \alpha_{MAF\text{-}10} N_{Ash}] / (x_{Dry\text{-}theor} N_{DryFuel} HHV_{Dry}) \quad (72A)$$

Column 4,
Equation (80) should read: -- $[X_{Dry\text{-}theor} N_{Dry\text{-}Fuel} + a_{Dry\text{-}theor} (1 + \phi_{Ref}) N_{Dry\text{-}Air} - J_{theor} N_{H2O} - x_{MAF\text{-}theor} \alpha_{MAF\text{-}10} N_{ash}] = [100 N_{DryGas/theor}]$ (80) --

Column 6,
Equation (84B) should read:
-- $\Xi_{AF} = [q_{Dry/Act} \rho_{DryGas/Act} m_{Wetfuel/theor} / (q_{DryGas/theor} \rho_{DryGas/theor} m_{As\text{-}Fired})] \cdot HHV/(HHVP+HBC)$ (84B) --

Column 9,
Lines 31-39, should read:
-- lbm-Dry Gas/million-Btu [ = ] [(100 $ft^3$ -Dry Gas/base) (lbm-Dry Gas/lbm-mole Dry Gas) ($ft^3$ -$CO_2$ /million-Btu)] / [(385.321 $ft^3$ -Dry Gas /lbm-mole Dry Gas) ·{($ft^3$ -$CO_2$ / $ft^3$ -Dry Gas) (100 $ft^3$ -Dry Gas/base)}] --

Alternatively, if $L_{Fuel/EPA}$ is used with units of $ft^3$-Dry Gas/million-Btu, applicable units for Eq.(91B) are:

$ft^3$ -Dry Gas/million-Btu [ = ]
[(100 $ft^3$ -Dry Gas/base) ($ft^3$ -$CO_2$ /million-Btu)]
/ {($ft^3$ -$CO_2$ / $ft^3$ -Dry Gas) (100 $ft^3$ -Dry Gas/base)}] --

Column 10,
Equations (92A) and (92B) should read:
-- $m_{As\text{-}Fired} = 385.321 \times 10^6 \Xi_{Gas} m_{DryGas/Act} d_{theor} / [100 N_{DryGas/theor} F_C \Xi_{AF} (HHVP+HBC)]$ (92A)
$m_{As\text{-}Fired} = 385.321 \times 10^6 \Xi_{Gas} m_{WetGas/Act} d_{theor} / [100 N_{DryGas/theor} F_C \Xi_{AF/Wet} (HHVP+HBC)]$ (92B) --

UNITED STATES PATENT AND TRADEMARK OFFICE

CERTIFICATE OF CORRECTION

PATENT NO. : 6,560,563 B1
DATED : May 6, 2003
INVENTOR(S) : Fred D. Lang

It is certified that error appears in the above-identified patent and that said Letters Patent is hereby corrected as shown below:

Column 11,
Lines 33-34, should read:
-- Method 19. $\Xi_{Gas}$ may be taken as unity for Eq.(92D) & (93D) or otherwise determined. --
Equation (94) should read:

$$-- 1.0 + AF_{\text{Dry-theor}} - (J_{\text{theor}} N_{H2O} + x_{\text{MAF-theor}}\, \alpha_{\text{MAF-10}}\, N_{\text{Ash}}) / (X_{\text{Dry-theor}}\, N_{\text{dry-Fuel}}) = 10^{-6}\, L_{\text{Fuel}}\, HHV_{\text{Dry}} \qquad (94) --$$

Column 14,
Line 67, should read: -- Factor for the high volatile B bituminous coal between --

Column 16,
Line 49, claim 7 should read:

7. The method of claim 6, including additional steps, after the step of dividing the total fuel energy flow, of:

obtaining a turbine cycle energy flow;
obtaining a boiler efficiency;
obtaining a turbine cycle based fuel heating value by dividing the turbine cycle energy flow by the product of the boiler efficiency and the fuel flow rate; and
adjusting the turbine cycle energy flow until the turbine cycle based fuel heating value and the fuel heating value are in reasonable agreement.

Column 18,
Line 1, claim 12 should read:

12. The method of claim 1, wherein the step of determining the correction to the L Factor includes the steps of:

obtaining a ratio of actual dry-gas effluent mass flow to actual wet fuel mass flow;
obtaining a ratio of the theoretical wet fuel mass flow to the theoretical dry-gas effluent mass flow; and
multiplying the ratio of actual dry-gas effluent mass flow to actual wet fuel mass flow by the ratio of the theoretical wet fuel mass flow to the theoretical dry-gas effluent mass flow resulting in the correction to the L Factor.

UNITED STATES PATENT AND TRADEMARK OFFICE

CERTIFICATE OF CORRECTION

PATENT NO. : 6,560,563 B1
DATED : May 6, 2003
INVENTOR(S) : Fred D. Lang

It is certified that error appears in the above-identified patent and that said Letters Patent is hereby corrected as shown below:

Column 18,
Line 13, claim 13 should read:

13. The method of claim 1, wherein the step of determining the correction to the L Factor includes the steps of:

obtaining a ratio of actual dry-gas effluent volumetric flow to theoretical dry-gas effluent volumetric flow;

obtaining a ratio of the actual dry-gas density to the theoretical dry-gas density used to convert the ratio of actual dry-gas effluent volumetric flow to theoretical dry-gas effluent volumetric flow;

obtaining a ratio of the theoretical wet fuel mass flow to the actual wet fuel mass flow; and multiplying the ratio of actual dry-gas effluent volumetric flow to theoretical dry-gas effluent volumetric flow by the ratio of the actual dry-gas density to the theoretical dry-gas density by ratio of the theoretical wet fuel mass flow to the actual wet fuel mass flow resulting in the correction to the L Factor.

Signed and Sealed this

Seventh Day of October, 2003

JAMES E. ROGAN
*Director of the United States Patent and Trademark Office*